United States Patent [19]

Schwarz

[11] 4,082,978

[45] Apr. 4, 1978

[54] COLOR TELEVISION, HAVING SUPERIMPOSED COLORS

[76] Inventor: Peter Schwarz, 1501 Rexford Drive, Los Angeles, Calif. 90035

[21] Appl. No.: 567,057

[22] Filed: Apr. 11, 1975

Related U.S. Application Data

[60] Continuation of Ser. No. 401,263, Sep. 27, 1973, which is a division of Ser. No. 36,294, May 11, 1970, Pat. No. 3,763,389.

[51] Int. Cl.[2] ..... H01J 29/28; H01J 29/32

[52] U.S. Cl. ..... 313/474; 313/472

[58] Field of Search ..... 313/408

[56] References Cited

U.S. PATENT DOCUMENTS

| | | | |
|---|---|---|---|
| 2,605,434 | 7/1952 | Homrighous | 313/474 X |
| 2,622,220 | 12/1952 | Geer | 313/416 |
| 2,837,676 | 6/1958 | Michlin | 313/472 |
| 3,005,921 | 10/1961 | Godfrey | 313/408 |
| 3,302,051 | 1/1967 | Galginaitis | 313/499 |

OTHER PUBLICATIONS

Yeh et al., Light-Emitting Diode Array, IBM Technical Disclosure Bulletin; vol. 9, No. 3; Aug., 1966; p. 326.

*Primary Examiner*—Robert Segal

[57] ABSTRACT

In color television, where the picture appears in groups of two or more colors side by side on a screen, an individual concave mirror is provided for each such group, which combines the side by side colors and also adds more light to the picture, or alternately uses less electric power for a given brightness.

5 Claims, 9 Drawing Figures

COLOR TELEVISION, HAVING SUPERIMPOSED COLORS

This is a continuation of application Ser. 401,263 filed Sept. 27, 1973, which is a divisional application of No. 36,294 filed May 11, 1970 now U.S. Pat. No. 3,763,389.

In shadow-mask type color-television the differently colored dots of each group are superimposed upon each other by means of concave mirrors, each group having its individual mirror. These mirrors are located either on the shadow-mask or on the backside of the screen. The mirrors also add additional light to the screen.

In color-television of the shadow-mask type, the picture appears in groups of three differently colored dots, situated in a circle, near each other. The picture is in mosaic form. In other media like color-photography, — cinematography — printing, etc., the colors are superimposed, which result in a better quality picture. It is, therefore, the main object of this invention to create for color-television on the viewing screen, a picture where the colors of each point are superimposed. It is another object to add more light to the screen. A further object is to reunite the elemental area of the original scene which was split into three components by the color camera. A related system has been disclosed and claimed in my copending application now U.S. Pat. No. 3,519,868.

It is well known that an essentially spherical concave mirror, which has as its radius of curvature the distance from the object to the mirror-surface, disregarding spherical and other aberrations will reflect back to the object an image, which is real, in focus and of the same size. But the image is inverted. It is the principle of this invention, to provide each group of phosphor dots, with collectively comprise the color screen with such a mirror.

As shown in FIG. 5 of the drawings, the letters R, G and B are the colored light sources of red, green and blue of one group arranged in a triad as they are formed on the screen by the electron beams, and in FIG. 6 there is shown is the inverted image of the same group which is superimposed upon the group shown in FIG. 5. The result is not only a better quality picture like in the other media but also a much brighter picture. This result is achieved since the viewed picture now more nearly approximates the original scene. Since each aperture of the shadow mask produces an elemental area, if 3 spots are controlled by each aperture the elemental area is reproduced as three independent monochromatic dots whereas in the present invention the elemental area would, in the preferred embodiment, be reproduced by no less than two dots in the single color case and by a light "mixture" in the multicolor case.

Figure 8:
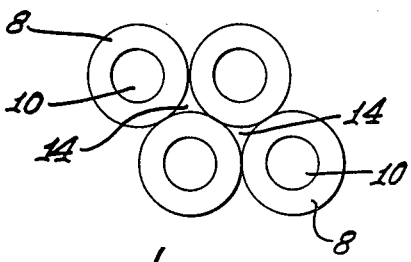

FIG. 8 contains four units of the shadow-mask showing the intervening spaces.

Figure 9:
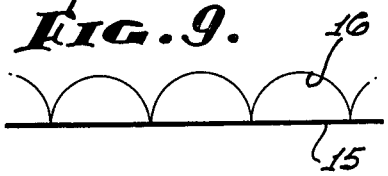

FIG. 9 is still another embodiment, relating to big screen projection color-television.

Figure 1:
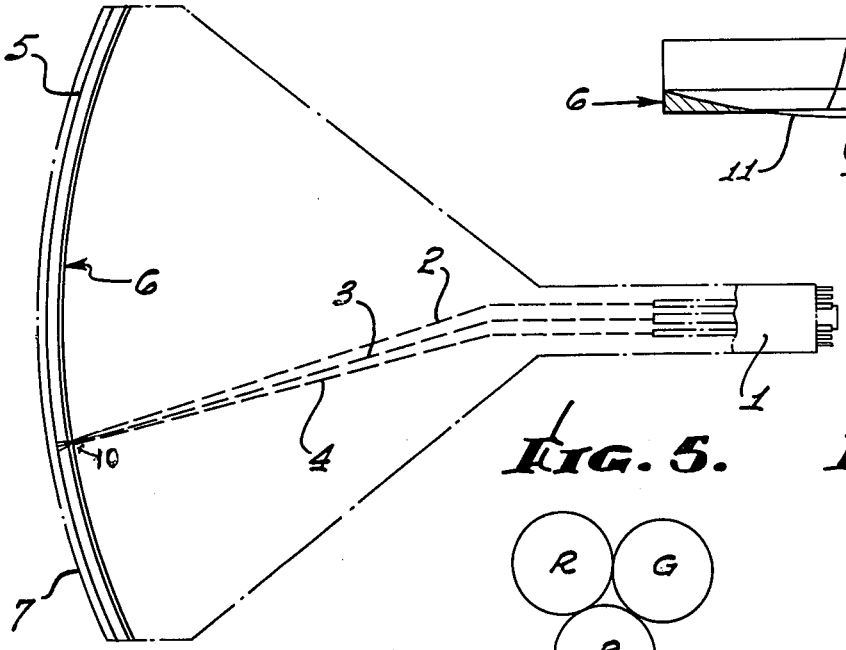
FIG. 1 shows the general construction of a shadow-mask color television tube.
Figure 2:
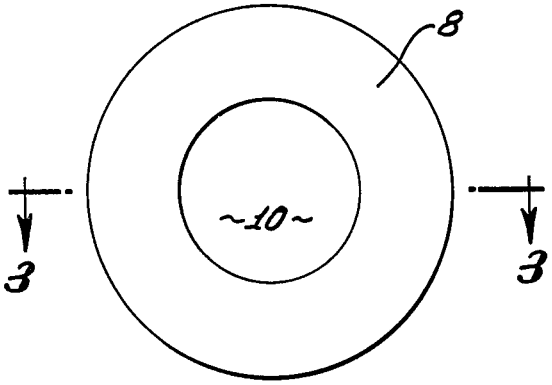
FIG. 2 is one enlarged unit of the shadow-mask.
Figure 3:
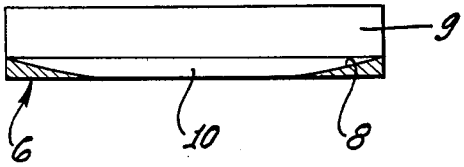
FIG. 3 is a cross-section of FIG. 2 taken along the line 3—3 in the direction of the appended arrows.

In FIG. 1, 1 is a three gun structure with its associated circuits, which emits electron beams 2, 3 and 4. These beams pass through the shadow-mask 6 which is a means of converging the electron beams to the appropriate phosphors at the opening having the general number 10 and hit the three different phosphors on the screen 5. These phosphors emit light of 3 different colors; red, green and blue, forward toward the viewer and also backward toward the shadow-mask. The light going toward the shadow-mask is about 40% more than that going toward the viewer. The shadow-mask in this mode of the invention is of somewhat thicker construction, one unit of which is shown in FIGS. 2 and 3. Imbedded in the shadow-mask material 6 around the opening 10 is an outer part of a single concave mirror 8 facing its group on the phosphor-screen. The axis of this mirror is in the direction of the center of the opening to the center of its group on the screen. The radius of curvature is about the distance of the shadow-mask from the screen. Each such mirror has on its outside periphery a shield 9 in FIG. 3 so that light only from its group will hit the mirror and will be reflected back to its group. The shield is of cylindrical shape and its axis coincides with the mirror axis. There is no interference with the electron beams. It may also be noted that the thickness of the shadow-mask at the opening to the electron-mask pass is zero.

The shadow-mask structure is made by the photochemical process, known in the art. On top of the shadow-mask material a light-sensitive coating is spread. A negative containing the necessary information is placed on top of such material. The negative is black where the opening is and gradually lighter toward the rim of each unit. The negative is exposed to light, which will affect the light sensitive coating. After removing the negative, the coating is developed in a solution, which dissolves the coating in a more or less degree as required by the negative. An etch is now used which will produce the desired openings and concavities in the shadow-mask. The shadow-mask is then covered with any mirrorizing material. The shield structure which is of non-reflective material is made in a similar manner by the same process. It is attached, in register, to the shadow-mask, by any convenient means and the whole structure is installed in the tube. The shield structure is held together by the intervening spaces shown by number 14 in FIG. 8. These spaces also cover the spaces on the shadow-mask and make them non-reflective, so that only the concave mirrors on the shadow-mask reflect light.

Figure 4:
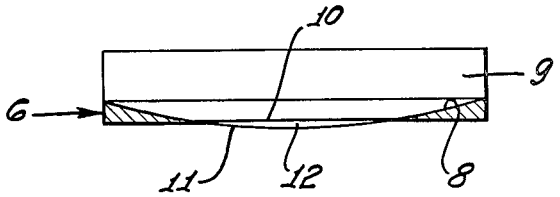
FIG. 4 is a cross-section of another embodiment of the invention.
Figure 5:
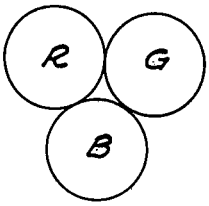
FIG. 5 shows the three colors as they are formed by means of the electron beams.
Figure 6:
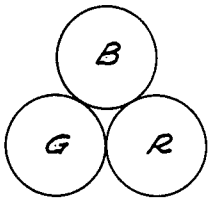
FIG. 6 shows the three colors as they are reflected by the concave mirror.
Figure 7:
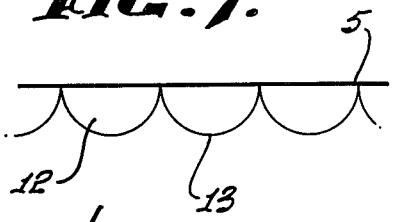
FIG. 7 represents another embodiment, the mirrors being adjacent to the phosphor screen.

In FIG. 4 another form of this invention is shown where the shadow-mask structure toward the screen is the same as in FIG. 2 and 3 but in addition has also an aluminized center part 11 of the mirror, being located on the side of the shadow-mask toward the electron gun, covering the opening, aluminum being transparent to electron-beams. The method of making of this center part mirror is substantially the same as in still another embodiment shown in FIG. 7 and described below. Adjacent to the phosphor screen 5 containing the groups of different phosphors on the side toward the gun are concave mirrors 13 in aluminized form in the shape of essentially half spheres. Each such mirror covers its own group. In the making of this embodiment, an electroconductive-light transmissive material 12, like Nitro-cellulose, Nesa, etc. is spread on the phosphor screen. A form is made containing the concavities of the mirrors by the photo-chemical process, using the shadow-mask on the screen as a reference. This form is pressed on the screen and the material 12 will assume the desired shape. After removing the form and drying the material 12, the aluminizing is performed. The shadow-mask of this tube is of the conventional type. This mode will also invert the image and superimpose the color dots and produce a better quality picture.

In still another form, this invention is applied to big screen, projection color-television as shown in FIG. 9. The big screen 15 whereon the picture is projected is made of a translucent material like ground glass, wax paper, etc. In back of it, away from the viewer, essentially half spherical concave full mirrors 16 are placed, one mirror for each group. These mirrors will invert and superimpose the images upon the color dots of each group. A conventional shadow-mask type projection tube is used. If any of the aforementioned embodiments were used this form would not be necessary. Although the present invention has been described in the environment of the conventional shadow mask, phosphor dot display system, it is clear that the invention could also be employed with any other display system, where the colors appear in a side by side form.

I claim:

1. In color television, the method of forming a picture on a screen consisting of groups of 2 or more dots emitting differently colored light forward and backward in combination with the step of reflecting an inverted image of each group back to its group, utilizing the backward light.

2. In color television the method comprising the steps of repeatedly scanning a screen with electrons, such screen consisting of plural groups of two or more different phosphors prearranged in a definite pattern and emitting light of different colors forward and backward, converging such electrons upon the appropriate phosphors of each group; in combination with the step of projecting by reflection a real and inverted image of each group back to its group on the screen in focus having essentially the same size as its group and using the backward light of its group only.

3. A color television tube having a screen consisting of a plurality of groups of at least two phosphortypes prearranged in a definite pattern, each phosphor type emitting in response to impinging electrons differently colored light both forward and backward an electron gunstructure including means for emitting and focusing electrons, means for deflecting the electrons and means for converging such electrons upon the appropriate phosphor types of each group; in combination with a concave mirror means for each group being fixedly positioned in the tube relative to its corresponding group and having a radius of curvature arranged to receive and reflect the backward light from the phosphors of each group to project a real and inverted image of each group back to the same group; such image being of essentially the same size as its group, in focus on the screen and using the light of its group only.

4. A color television tube having a screen consisting of a plurality of groups of at least two different phosphortypes prearranged in a definite pattern, each phosphortype in response to impinging electrons emitting differently colored light both forward and backward an electron gunstructure, including means for emitting and focusing electrons means for deflecting the electrons and means for converging such electrons upon the appropriate phosphor types of each group; in combination with thin concave mirrors able to allow the impinging electrons to reach the phosphors, each said mirror being fixedly positioned on the screen, one for each group and covering its group and having a radius of curvature arranged to receive and reflect backward light from the phosphors of each group back to the same group, such image being in focus on the screen, having essentially the same size as the group and using the light of its group only.

5. The contents of claim 4 and also including an electro-conductive light transmissive layer between said concave reflective surfaces and the phosphors.

* * * * *